US007317894B2

(12) United States Patent
Hirose

(10) Patent No.: US 7,317,894 B2
(45) Date of Patent: Jan. 8, 2008

(54) SATELLITE DIGITAL RADIO BROADCAST RECEIVER

(75) Inventor: Koji Hirose, Setagaya-ku (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 288 days.

(21) Appl. No.: 10/781,726

(22) Filed: Feb. 20, 2004

(65) Prior Publication Data

US 2004/0168193 A1 Aug. 26, 2004

(30) Foreign Application Priority Data

Feb. 26, 2003 (JP) ..... 2003-048572

(51) Int. Cl.
*H04H 1/00* (2006.01)

(52) U.S. Cl. ..... 455/3.02; 455/234.1; 455/250.1

(58) Field of Classification Search ..... 455/3.01–3.02, 455/234.1, 232.1, 272, 277.1, 277.2, 226.1, 455/226.2, 67.11, 67.12, 133, 136; 725/68–71, 725/63–64

See application file for complete search history.

(56) References Cited

U.S. PATENT DOCUMENTS 5,095,533 A * 3/1992 Loper et al. ..... 455/249.1
5,301,352 A * 4/1994 Nakagawa et al. ..... 725/71
5,319,673 A * 6/1994 Briskman ..... 455/13.1
5,794,138 A * 8/1998 Briskman ..... 455/344
5,966,186 A * 10/1999 Shigihara et al. ..... 348/570
6,078,796 A * 6/2000 Ling ..... 455/234.1
6,091,931 A * 7/2000 Ben-Efraim et al. ..... 455/3.02
6,301,313 B1 * 10/2001 Gevargiz et al. ..... 375/340
6,484,042 B1 * 11/2002 Loke ..... 455/234.1
6,498,927 B2 * 12/2002 Kang et al. ..... 455/245.2
6,510,317 B1 * 1/2003 Marko et al. ..... 455/428
6,549,774 B1 * 4/2003 Titlebaum et al. ..... 455/427
6,557,029 B2 * 4/2003 Szymansky ..... 455/13.1
6,584,090 B1 * 6/2003 Abdelgany et al. ..... 455/82
6,735,416 B1 * 5/2004 Marko et al. ..... 455/3.02
2001/0022821 A1 * 9/2001 Ichihara ..... 375/345
2001/0041532 A1 * 11/2001 Tomasz et al. ..... 455/3.02
2002/0025792 A1 * 2/2002 Isoda ..... 455/234.1
2004/0229583 A1 * 11/2004 Ogino ..... 455/3.01
2005/0124289 A1 * 6/2005 Coffin, III ..... 455/3.02
2007/0004351 A1 * 1/2007 Dekker ..... 455/127.1

* cited by examiner

*Primary Examiner*—Lana Le
(74) *Attorney, Agent, or Firm*—Eric J. Robinson; Robinson Intellectual Property Law Office, P.C.

(57) ABSTRACT

A satellite digital radio broadcast receiver has an integrated circuit including a first reception series for processing a satellite wave signal from a satellite and a second reception series for processing a ground wave signal from a repeater in order to receive both the satellite wave signal and the ground wave signal having the same broadcast contents and different modulation methods. The receiver has an automatic gain control unit for amplifying a signal from a single antenna at a variable gain amplifier, and in accordance with the level of a signal outputted from the variable gain amplifier, for controlling the gain of the variable gain amplifier; and a two-way distributor for distributing an output of the automatic control unit to two distribution outputs, wherein one distribution output of the two-way distributor is supplied to the first reception series of the integrated circuit and the other distribution output is supplied to the second reception series of the integrated circuit.

2 Claims, 8 Drawing Sheets

SATELLITE DIGITAL RADIO BROADCAST RECEIVER

BACKGROUND OF THE INVENTION

1. Field of the Invention

The present invention relates to a satellite digital radio broadcast receiver for receiving a broadcast program having the same contents but different modulation methods.

2. Related Background Art

Satellite digital radio broadcasting from a plurality of elliptical orbit satellites moving along a so-called figure 8 orbit is presented, for example, by US SIRIUS Satellite Radio Incorporated. The outline of the whole system of satellite broadcast is shown in FIG. 1. This broadcast system uses one Geo stationary satellite and three elliptical orbit satellites (not stationary satellite) each moving along a figure 8 orbit. Since the service area is the North America, if a Geo stationary satellite only is used, the elevation angle of an antenna is low so that this is not suitable for mobile stations. An elliptical orbit satellite moves along the figure 8 orbit so that it does not always locate overhead. Therefore, a radio broadcast receiver sequentially and alternately receives a signal from any two satellites among the three elliptical orbit satellites.

In an area where it is difficult to receive a radio wave from an elliptical orbit satellite or in an urban area where it is difficult to receive a satellite broadcast radio wave, a radio broadcast receiver receives in some cases a radio wave (ground wave) from a ground repeater which is controlled by a Geo stationary orbit satellite. Therefore, the satellite radio broadcast receiver receives three radio waves in total, two satellite waves and one ground wave, at the same time at its wide band RF amplifier. FIG. 2 shows the spectrum of radio waves to be received by the receiver. The center frequency of this spectrum is approximately 2.3 GHz, and the satellite wave and ground wave have both the band width of about 4 MHz. Although the satellite wave #1 and the ground wave are received at the same timing, the satellite wave #2 is received at the timing delayed by several seconds, and so time diversity is presented. Of three satellite waves from the elliptical orbits, the satellite wave #1 or #2 is used depending upon their orbits so that the control for the time diversity and also fine frequency tuning are carried out. In the receiver, a band-pass filter built in the tuner unit separates each band, and the received signals are demodulated, combined and thereafter synthesized through synchronization.

The features of this satellite digital radio broadcast system are summarized as in the following:

1) Features of Radio Waves

Since a ground wave has a propagation path different from that of a satellite wave, the way how the level fluctuates and the like are different from those of the satellite wave.

Since the satellite wave is transmitted from a satellite on the elliptical orbit, it is received by the receiver at a high elevation angle. Since the propagation path does not change largely, the satellite wave can be received reliably unless the mobile station enters a tunnel or passes under a high way.

2) Features of Reception System

The receiver receives three waves containing the same contents. However, each radio wave has different frequency and propagation path, and a different time period while the same data is received. These radio waves are synthesized and demodulated so that the effects of frequency diversity, space diversity and time diversity can be obtained.

FIG. 3 shows the structure of a tuner unit of a satellite digital broadcast receiver 20 of the current system.

In the tuner having the structure shown in FIG. 3, an antenna 11 receives a radio wave signal from a ground repeater, i.e., a ground signal, the antenna having the directional characteristics matching the ground signal. The band of the received signal is limited by a band-pass filter 12, and an output of the band-pass filter 12 is selectively supplied either to a high frequency amplifier 13 or an attenuator 14 to be amplified or attenuated. An antenna 21 receives a radio wave signal from a satellite, i.e., a satellite signal, the antenna having the directional characteristics matching the satellite signal. The band of the received signal is limited by a band-pass filter 22.

An output signal from the high frequency amplifier 13 or an output signal from the attenuator 14 is amplified by a variable gain amplifier 15, and an output of this amplifier is supplied to a mixer 16 whereat it is converted into an intermediate frequency easy to be processed. An output of the mixer 16 is detected by a detector 17 to obtain a detection voltage corresponding to the input signal level. This detection voltage is supplied to a control circuit 18 which determines a gain of the variable gain amplifier 15 in accordance with the supplied detection voltage, to thereby perform an automatic gain control (AGC). An output of the mixer 16 is also sent as a ground signal to an intermediate frequency stage to be subjected to an intermediate frequency process. An output of the intermediate frequency stage is supplied to a demodulation stage to be subjected to a demodulation process. If the input signal level is judged small from the detection voltage, the high frequency amplifier 13 is selected by switches 19*a* and 19*b*, whereas if the input signal level is large, the attenuator 14 is selected by the switches 19*a* and 19*b*.

An output signal from the band-pass filter 22 is amplified at a variable gain amplifier 25, and an output of this amplifier is supplied to a mixer 26 whereat it is converted into an intermediate frequency easy to be processed. An output of the mixer 26 is detected by a detector 27 to obtain a detection voltage corresponding to the input signal level. This detection voltage is supplied to a control circuit 28 which determines a gain of the variable gain amplifier 25 in accordance with the supplied detection voltage, to thereby perform AGC. An output of the mixer 26 is also sent as a satellite signal to an intermediate frequency stage to be subjected to an intermediate frequency process. An output of the intermediate frequency stage is supplied to a demodulation stage to be subjected to a demodulation process.

The variable gain amplifiers 15 and 25, mixers 16 and 26, detectors 17 and 27 and control circuits 18 and 28 are fabricated in an integrated circuit IC. There are two series, a ground wave signal series including the variable gain amplifier 15, mixer 16, detector 17 and control circuit 18, and a satellite wave signal series including the variable gain amplifier 25, mixer 26, detector 27 and control circuit 28. The reason of division into two series is that although the broadcast contents are the same, the modulation methods are different between the ground wave signal of an OFDM modulation and the satellite wave signal of a QPSK modulation, the bands at the succeeding intermediate frequency stages are different and the gain distributions are different.

In the satellite digital radio broadcast receiver described above, the frequency of a received satellite wave signal is adjacent to that of a received ground wave signal. These two signals, the satellite wave reception signal and ground wave reception signal, are input to the two series of the tuner. Since different gain settings are performed in the integrated circuit IC of the tuner because of different levels of the satellite wave reception signal and ground wave reception signals and the like, the tuner is divided into the two series in the integrated circuit IC.

The tuner of the satellite digital radio broadcast receiver 20 receives an adjacent disturbance wave signal b such as shown in FIG. 4. In order to process this disturbance signal, the switching circuit for switching between the high frequency amplifier 13 and attenuator 14 is provided at the front stage of the integrated circuit IC in the ground wave signal reception series. This switching circuit operates in response to the output level of the detector 17 provided in the integrated circuit IC to thereby control the level of an input signal to the integrated circuit IC. In FIG. 4, reference character a represents the level of a desired reception signal.

A digital AGC method is known as disclosed, for example, in Japanese Patent Laid-open Gazette No. 10-56343. With this method, in accordance with an electric field intensity detected from an output of an intermediate frequency signal, the gain of a variable gain amplifier is controlled, and an output of the variable gain amplifier is orthogonally detected, and in accordance with a difference between the orthogonally detected IQ output signal amplitudes and desired IQ output signal amplitudes, the gain of the variable gain amplifier is finely adjusted.

With the conventional tuner structure of the satellite digital radio broadcast receiver described above, it is, however, necessary to set a hysteresis to the switching circuit in order to prevent the switching between the high frequency amplifier 13 and attenuator 14 from being fluttered due to a reception signal level. A satellite digital radio broadcast receiver has as its one objective using it mounted on a vehicle. The reception condition during vehicle running is influenced by a multi-path and the like so that the signal level may change abruptly by 15 dB or more.

It is therefore necessary that the switching hysteresis is 15 dB or larger. Further, since a digital modulation method is incorporated for the satellite digital radio broadcast, if the reception signal is once intercepted, there is some idle time before sounds can be reproduced, because data synchronization and the like are necessary. A complicated control process is therefore required such as matching the switching timing for signal level control to the data transition period and fixing the synchronization circuit and the like during such period.

From these reasons, the level adjustment of a ground wave signal input to the integrated circuit IC is something intermittent. FIG. 5 shows the disturbance wave elimination characteristics actually measured. As shown, the characteristics are stepwise and there are an input signal level having the bad disturbance wave elimination characteristics and an input signal level having the good disturbance wave elimination characteristics. There is a difference of 10 dB or more between these signal levels. If a signal cannot be received once because of the switching hysteresis control, even if the disturbance signal level lowers somewhat, it is not so fast until the reception is recovered. The hatched area in FIG. 5 indicates a reception enabled range.

SUMMARY OF THE INVENTION

It is an objective of the present invention to provide a satellite digital radio broadcast receiver capable of eliminating the above-described disadvantages and improving the disturbance wave elimination characteristics with a simple structure.

According to one aspect of the present invention, there is provided a satellite digital radio broadcast receiver having an integrated circuit including a first reception series for performing a reception processing of a satellite wave signal from a satellite and a second reception series for performing a reception processing of a ground wave signal from a repeater in order to receive both the satellite wave signal and the ground wave signal having the same broadcast contents and different modulation methods, the satellite digital radio broadcast receiver comprising: automatic gain control means for amplifying a signal from a single antenna at a variable gain amplifier, and in accordance with a level of a signal outputted from the variable gain amplifier, for controlling a gain of the variable gain amplifier to control the level of the signal outputted from the variable gain amplifier; and a two-way distributor for distributing an output of the automatic control means to two distribution outputs, wherein one distribution output from the two-way distributor is supplied to the integrated circuit as an input signal to the first reception series, and the other distribution output from the two-way distributor is supplied to the integrated circuit as an input signal to the second reception series.

According to the satellite digital radio broadcast receiver, the input signals to the first and second reception series of the integrated circuit have the levels controlled by the automatic gain control means. Therefore, the input signal level can be maintained generally constant even if there is a sharp change in a disturbance signal level.

As above, according to the satellite digital radio broadcast receiver of this invention, only one series can suffice for the input signals to the integrated circuit so that the receiver can be made compact and the cost can be reduced.

DESCRIPTION OF THE PREFERRED EMBODIMENT

Description will be made on a satellite digital radio broadcast receiver according to an embodiment of the invention.

Figure 6:
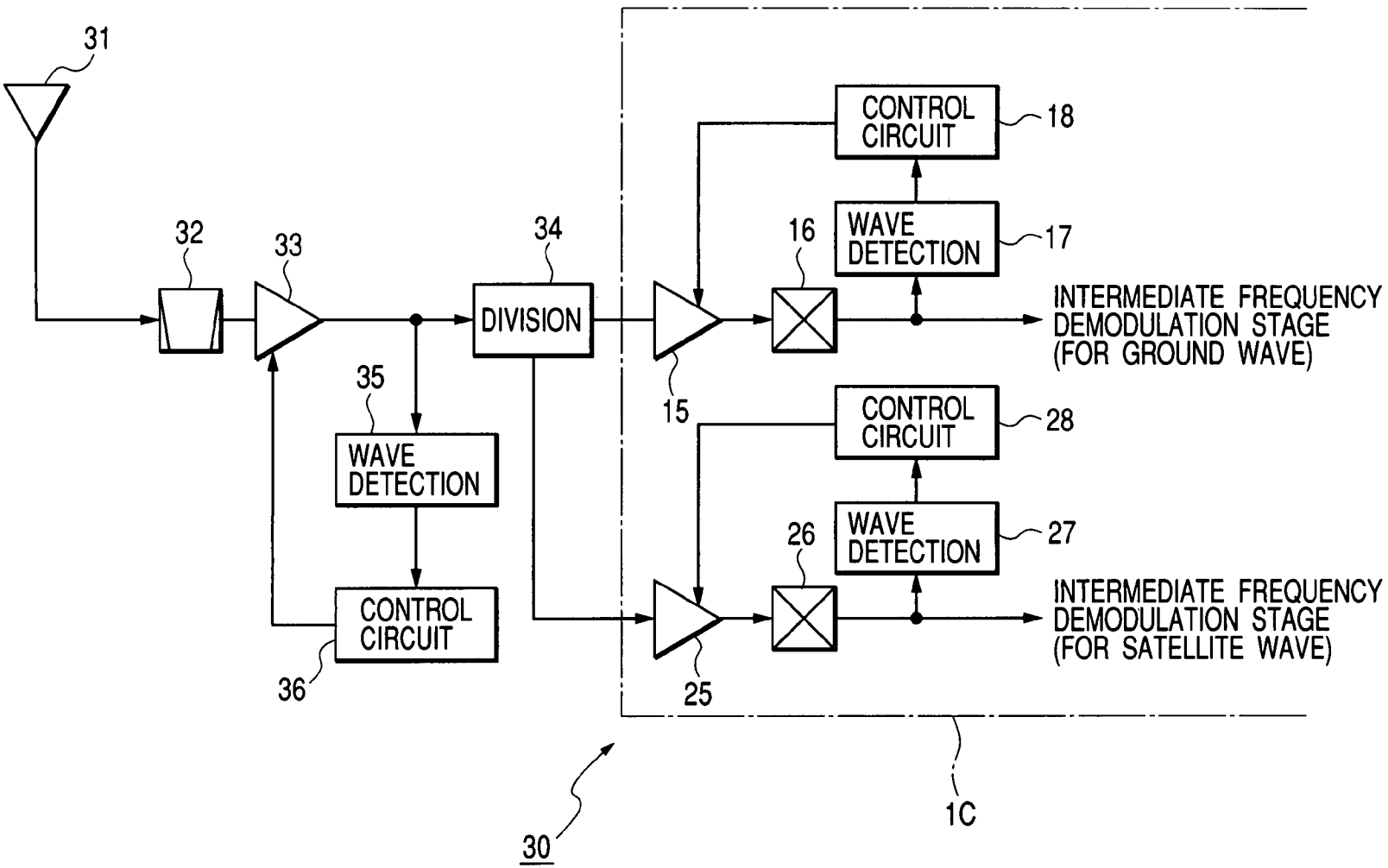
FIG. 6 is a block diagram showing the structure of a tuber unit of a satellite digital radio broadcast receiver according to an embodiment of the invention.

FIG. 6 is a block diagram showing the structure of a tuner unit of a satellite digital radio broadcast receiver according to the embodiment of the invention.

Figure 1:
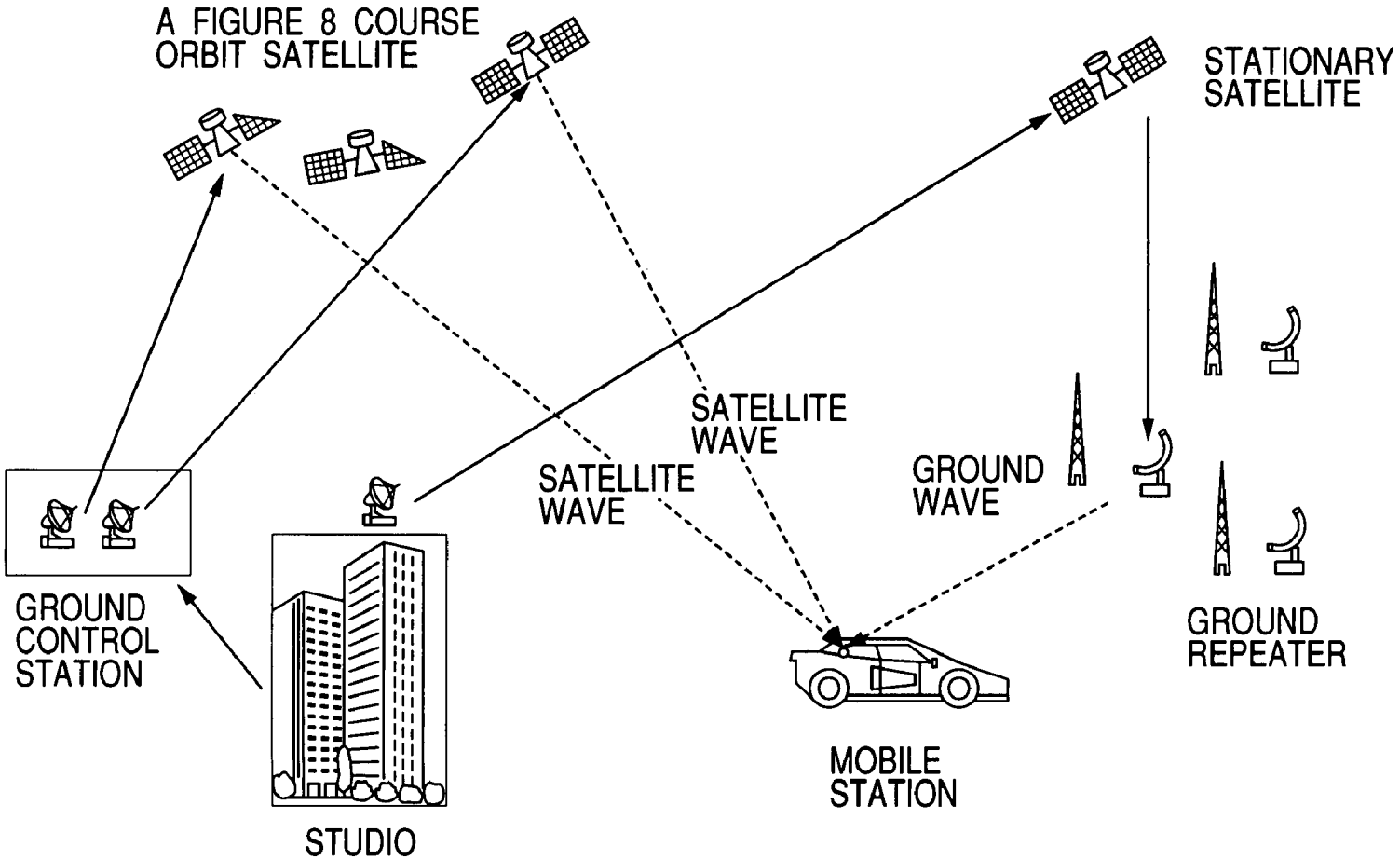
FIG. 1 is a diagram showing the outline of a satellite digital radio broadcast system.
Figure 2:
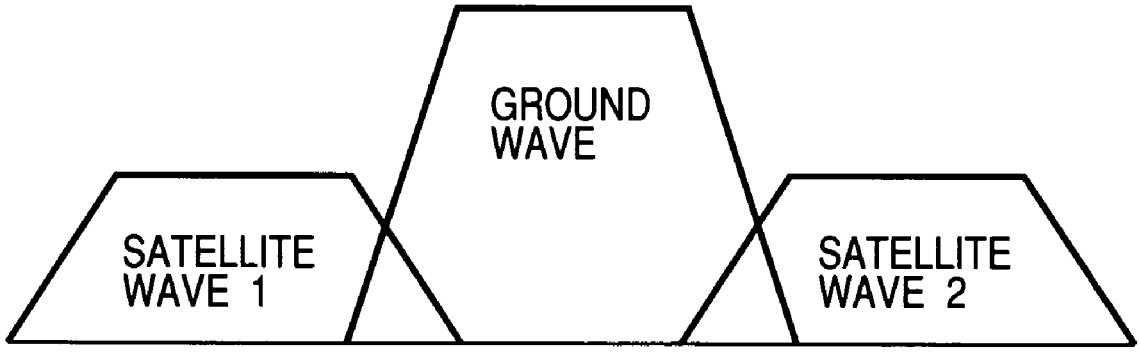
FIG. 2 is a diagram showing the spectrum of radio waves to be received by a satellite digital radio broadcast receiver.
Figure 3:
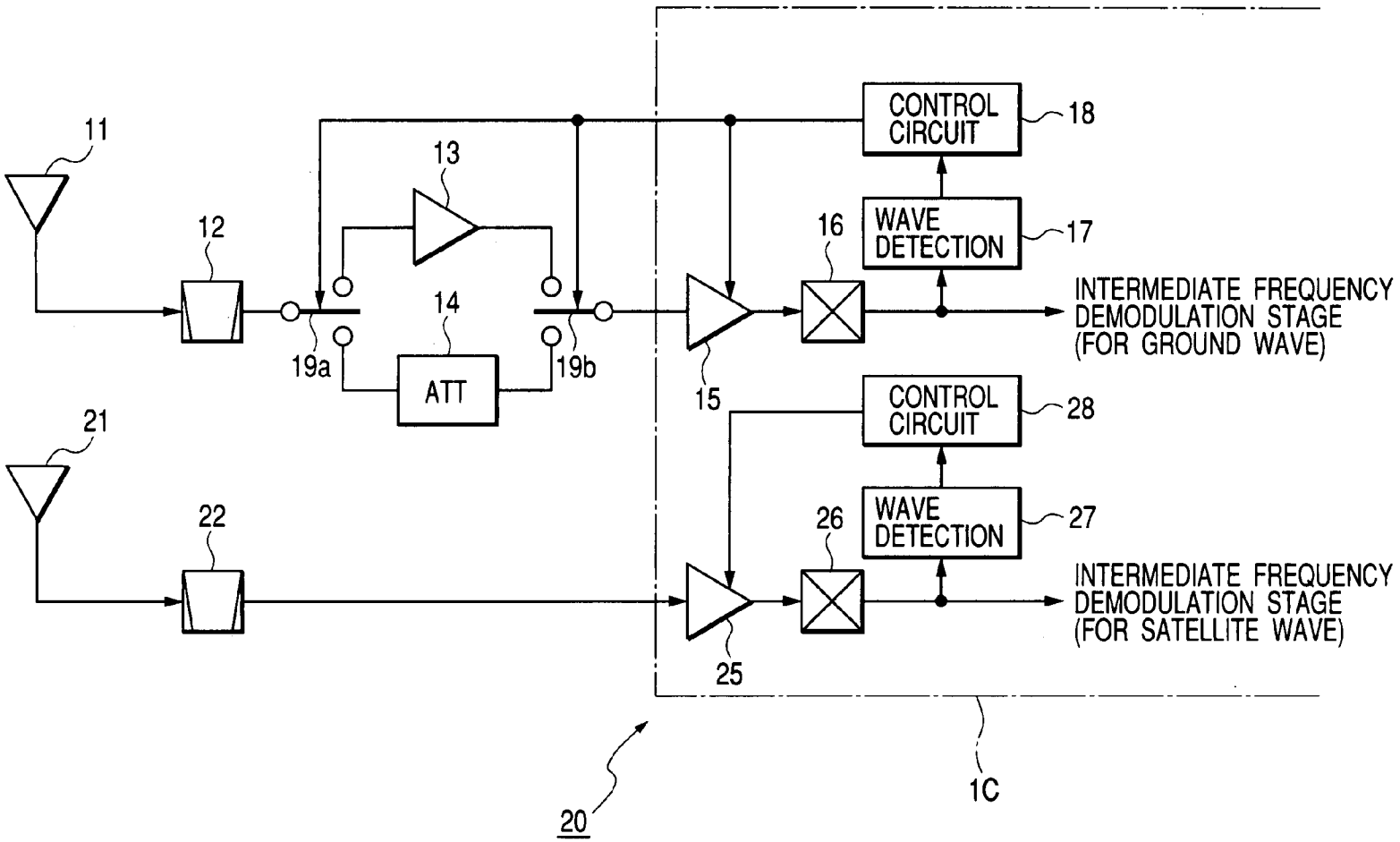
FIG. 3 PRIOR ART
FIG. 3 is a block diagram showing the structure of a tuner unit of a conventional satellite digital radio broadcast receiver.
Figure 4:
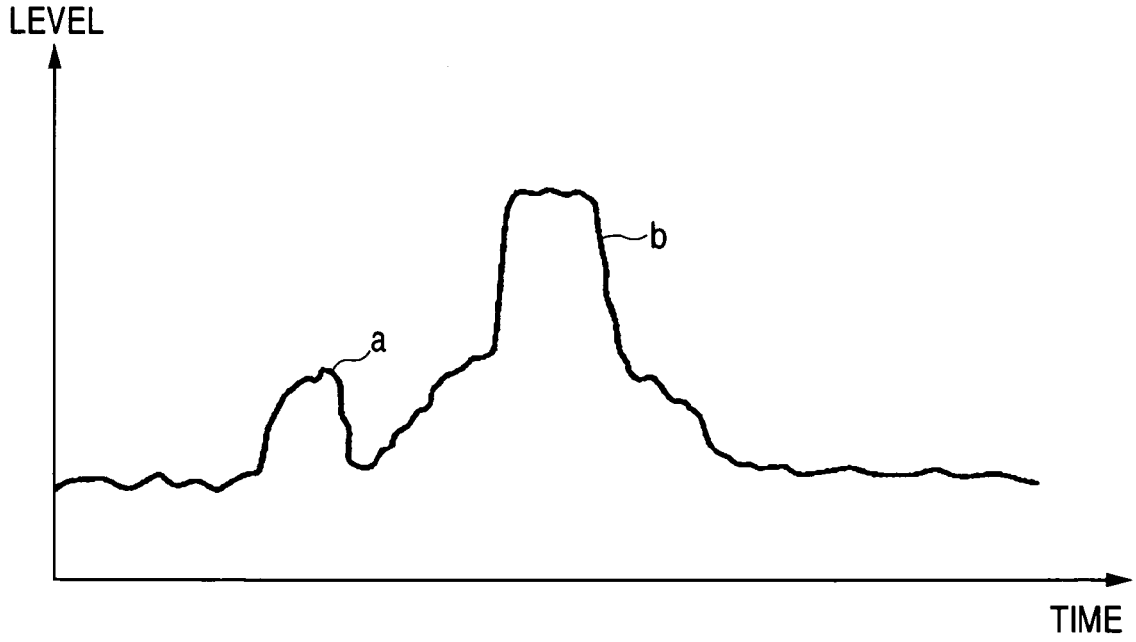
FIG. 4 is the characteristic diagram explaining the disturbance signal elimination characteristics of a conventional satellite digital radio broadcast receiver.

In the satellite digital radio broadcast receiver 30 of the embodiment, an antenna 31 receives a satellite wave signal and a ground wave signal. The band of the received signal is limited by a band-pass filter 32, and an output of the band-pass filter 32 is supplied to and amplified at a voltage control type variable gain amplifier 33. An output signal from the voltage control type variable gain amplifier 33 is supplied to a two-way distributor 34 which inputs two-way distributed output signals to variable gain amplifiers 15 an 25 of an integrated circuit IC, respectively. The integrated circuit IC has the same structure as the integrated circuit IC shown in FIG. 3, and so the description of the structure and operation thereof is omitted.

An output of the voltage control type variable gain amplifier 33 is detected by a detector 35 to obtain a detection voltage corresponding to the input signal level. This detection voltage is supplied to a control circuit 36 which converts it into an AGC control voltage. The AGC control voltage is supplied as a gain control voltage to the voltage control type variable gain amplifier 33 to perform AGC and control the level of an input signal to the integrated circuit IC. The antenna 31 is either an antenna for receiving a satellite wave signal or an antenna for receiving a ground wave signal.

The two-way distributor 34 distributes an input at a distribution ratio suitable for gains of two series in the integrated circuit IC and supplies the distributed signals to the variable gain amplifiers 15 and 25, respectively. A better one of the demodulation signals of the two series is selected and output, similar to conventional techniques.

Figure 5:
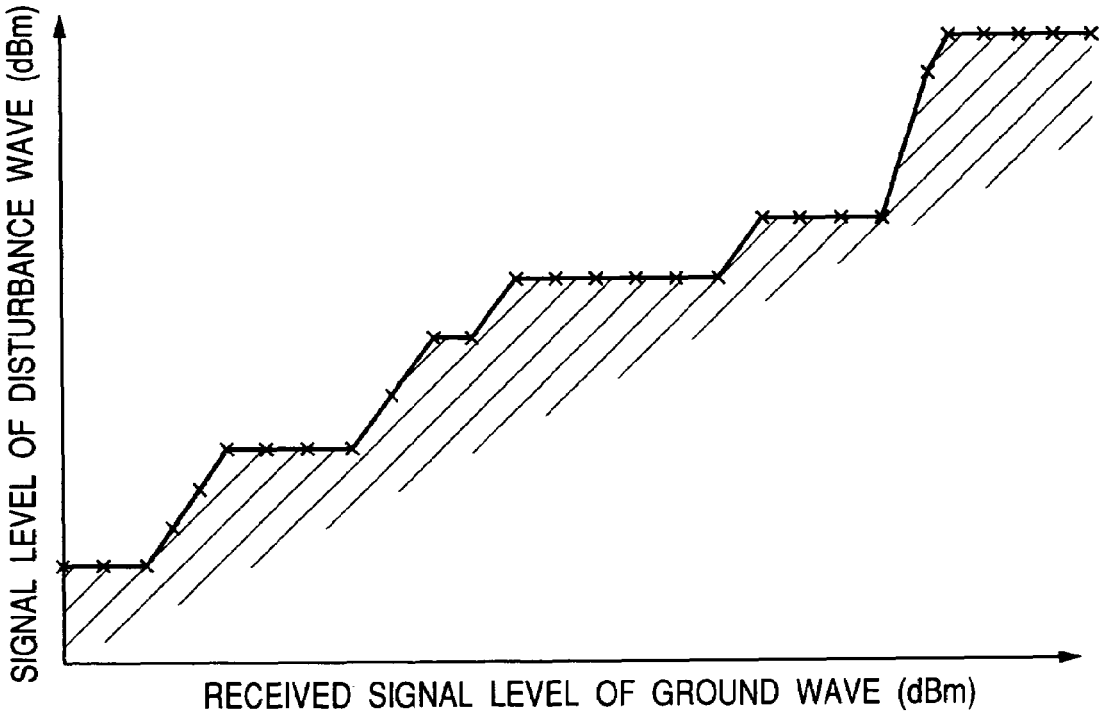
FIG. 5 is a schematic diagram explaining a disturbance radio wave to be received by a conventional satellite digital radio broadcast receiver.
Figure 7:
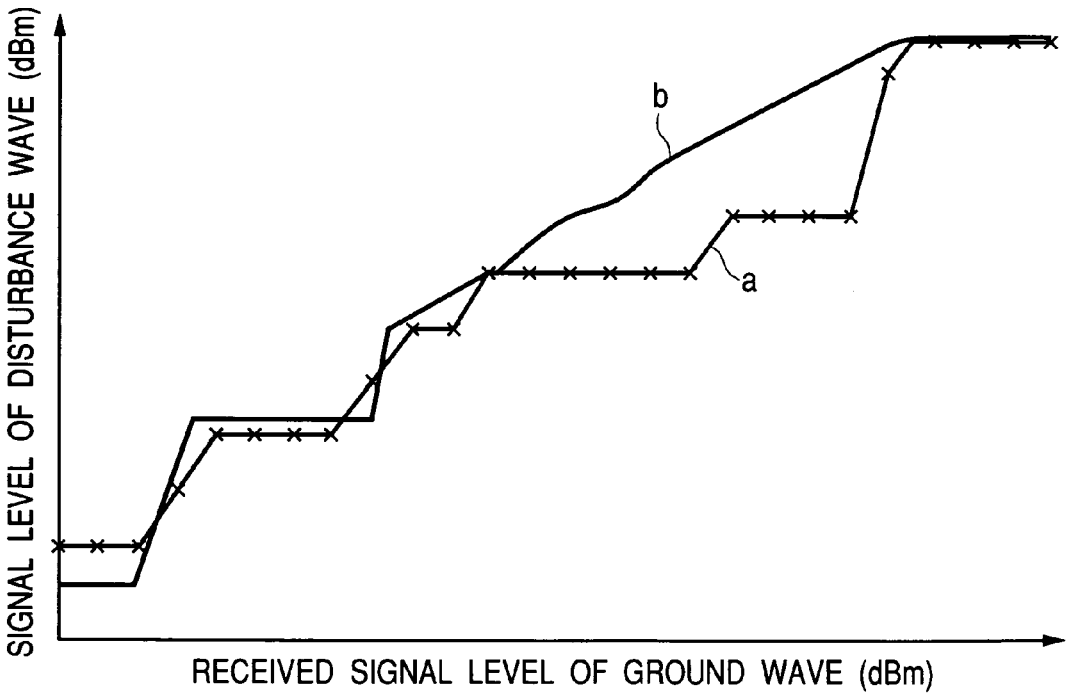
FIG. 7 is the characteristic diagram explaining the disturbance signal elimination characteristics of the satellite digital radio broadcast receiver of the embodiment.

As described above, in the tuner unit of the satellite digital radio broadcast receiver 30, the level of an input signal to the integrated circuit IC is controlled by AGC, and signals having AGC controlled levels are distributed to the two series of the integrated circuit IC. Therefore, the level of an input signal to the integrated circuit IC is controlled continuously in an analog fashion, so that the input signal level is not switched intermittently as in the case of conventional techniques. As indicated at b in FIG. 7, the disturbance signal elimination characteristics will not be degraded abruptly so that even a sharp change in a disturbance signal level can be followed smoothly. In addition, even if the receiver is mounted on a vehicle, broadcast reception is hardly broken. The disturbance signal elimination characteristics indicated at a in FIG. 7 are the same as those shown in FIG. 5.

Figure 8:
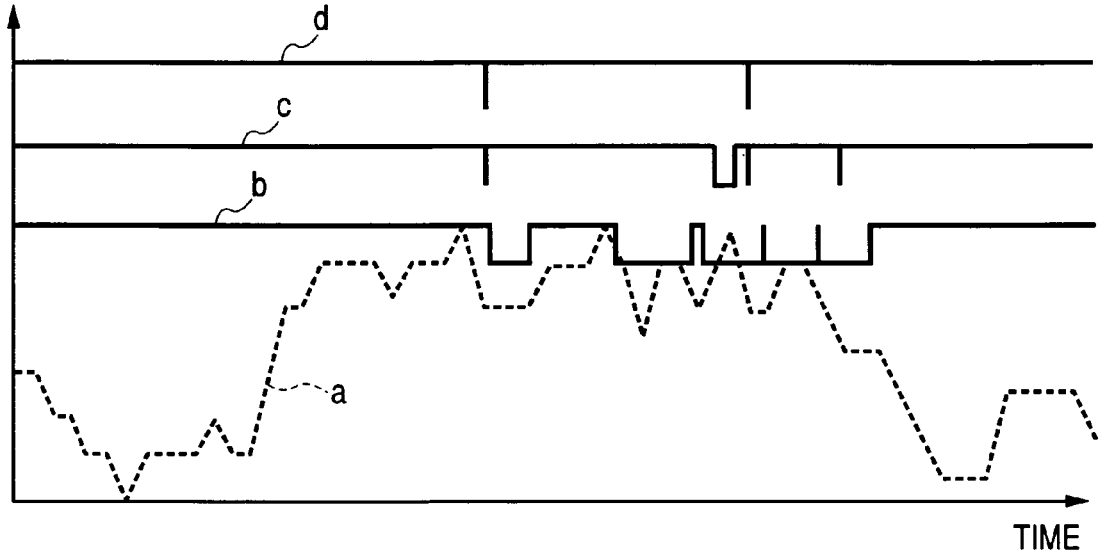
FIG. 8 is a schematic diagram explaining a disturbance radio wave to be received by the satellite digital radio broadcast receivers of the embodiment and the prior art.

FIG. 8 is a schematic diagram showing actual measurements by the satellite digital radio broadcast receiver 30 of the embodiment and the conventional receiver 20, both mounted on a vehicle running through the New York city. The level of a disturbance wave is indicated at a in FIG. 8. A line indicated at b in FIG. 8 shows the selection state between the high frequency amplifier 13 and attenuator 14. The high level line indicates a selection of the high frequency amplifier 13, and the low level line indicates a selection of the attenuator 14. A line indicated at c in FIG. 8 schematically illustrates a muting state of an audio output when the level of an input signal to the integrated circuit IC is controlled by switching between the high frequency amplifier 13 and attenuator 14 upon reception of the disturbance wave a. The high level line indicates the period while the muting state is removed and an audio signal is obtained, and the low level line indicates the period while the muting state is effected and an audio signal cannot be obtained. A line indicated at d in FIG. 8 schematically illustrates a muting state of an audio signal when the level of an input signal to the integrated circuit IC is controlled by the voltage control type variable gain amplifier 33 upon reception of the disturbance wave a. The high level line indicates the period while the muting state is removed and an audio signal is obtained, and the low level line indicates the period while the muting state is effected and an audio signal cannot be obtained.

As apparent from the comparison between the lines c and d in FIG. 8, as compared to the satellite digital radio broadcast receiver 20, the satellite digital radio broadcast receiver 30 has a shorter sound interception period and a shorter reception stop period.

Since the satellite digital radio broadcast receiver 30 has only one series as the front end of the integrated circuit IC, it can be made compact and the cost can be reduced.

As described so far, according to the satellite digital radio broadcast receiver, only one series is used as the front end of the integrated circuit, and the level of an input signal to the integrated circuit is controlled by AGC. Accordingly, the satellite digital radio broadcast receiver has a shorter sound interception period and a shorter reception stop period. Furthermore, since the satellite digital radio broadcast receiver 30 has only one series as the front end of the integrated circuit IC, it can be made compact and the cost can be reduced.

What is claimed is:

1. A satellite digital radio broadcast receiver having an integrated circuit including a first reception series for performing a reception processing of a satellite wave signal from a satellite and a second reception series for performing a reception processing of a ground wave signal from a repeater in order to receive both the satellite wave signal and the ground wave signal having the same broadcast contents and different modulation methods, a total gain through the first reception series being different from a total gain through the second reception series, the satellite digital radio broadcast receiver comprising:

automatic gain control means for amplifying a signal from a single antenna at a variable gain amplifier, and in accordance with a level of a signal outputted from the variable gain amplifier, for controlling a gain of the variable gain amplifier to control the level of the signal outputted from the variable gain amplifier; and a two-way distributor for distributing an output of the automatic gain control means to two distribution outputs, wherein one of the two distribution outputs from the two-way distributor is supplied to said integrated circuit as an input signal to the first reception series, and the other of the two distribution outputs from the two-way distributor is supplied to the integrated circuit as an input signal to the second reception series, and wherein the two-way distributor operates to distribute an input at a distribution ratio according to the difference between the total gain through the first reception series and the total gain through the second reception series.

2. The satellite digital radio broadcast receiver according to claim 1, wherein the antenna is either an antenna for receiving the satellite wave signal or an antenna for receiving the ground wave signal.

* * * * *